US012116858B2

(12) United States Patent
Hashim et al.

(10) Patent No.: US 12,116,858 B2
(45) Date of Patent: Oct. 15, 2024

(54) WELLBORE ANNULUS SEAL SYSTEM

(71) Applicant: Saudi Arabian Oil Company, Dhahran (SA)

(72) Inventors: Abdulrhman M. Hashim, Dammam (SA); Mohammed K. Muqri, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/070,001

(22) Filed: Nov. 28, 2022

(65) Prior Publication Data

US 2024/0175331 A1 May 30, 2024

(51) Int. Cl.
*E21B 33/12* (2006.01)

(52) U.S. Cl.
CPC ..... *E21B 33/1208* (2013.01); *E21B 2200/01* (2020.05)

(58) Field of Classification Search
CPC ... E21B 33/1208; E21B 2200/01; E21B 33/00
See application file for complete search history.

(56) References Cited

U.S. PATENT DOCUMENTS

| | | | | |
|---|---|---|---|---|
| 2,824,757 | A * | 2/1958 | Rhodes | E21B 33/0422 285/123.8 |
| 4,718,679 | A * | 1/1988 | Vyvial | E21B 33/03 277/328 |
| 11,434,714 | B2 | 9/2022 | Machocki | |
| 2016/0138352 | A1 | 5/2016 | Leba et al. | |
| 2021/0399464 | A1 | 12/2021 | James et al. | |
| 2022/0243549 | A1 | 8/2022 | Hosie et al. | |

* cited by examiner

*Primary Examiner* — Tara Schimpf
*Assistant Examiner* — Jennifer A Railey
(74) *Attorney, Agent, or Firm* — Fish & Richardson P.C.

(57) ABSTRACT

An annulus seal system includes a retention plate mounted to a tubing in a wellbore at an uphole longitudinal end of the tubing and an annular isolation system coupled to the retention plate. The annular isolation system includes a bottom holding plate positioned in an annulus between two tubings, a seal element residing on the bottom holding plate to seal the annulus between the tubings, a torque plate, and a top holding plate. The seal element is positioned between the bottom holding plate and the torque plate, and the torque plate moves in a longitudinal direction toward the bottom holding plate to compress the seal element between the bottom holding plate and the torque plate. The top holding plate mounts to the retention plate, and includes an adjustment mechanism engaged with the torque plate to control movement of the torque plate in the longitudinal direction.

18 Claims, 4 Drawing Sheets

WELLBORE ANNULUS SEAL SYSTEM

TECHNICAL FIELD

This disclosure relates to well seal systems, and more particularly to seals for a wellbore annulus.

BACKGROUND

Drilling and production operations of a hydrocarbon well require control of a wellbore environment. In the oil and gas industry, wellheads are installed over open wellbores and on top of one or more surface casing that extend at least partially into the wellbore. Tubing installed in the wellbore prior to the installation of the surface casings are often called conductors. The annulus or annuli between various conductors or between a conductor and a surface casing are often cemented or left open since no flowing formations are expected to flow through these annuli to the surface.

SUMMARY

This disclosure describes annulus seal systems, such as seal systems in tubing annuli in a wellbore.

In some aspects, an annulus seal system includes a retention plate that mounts to a first tubing in a wellbore at an uphole longitudinal end of the first tubing. The retention plate includes a first surface. The annulus seal system also includes an annular isolation system to couple to the retention plate. The annular isolation system includes a bottom holding plate positioned in an annulus between the first tubing and a second tubing that is positioned adjacent to the first tubing, a seal element residing on the bottom holding plate, where the seal element can seal the annulus between the first tubing and the second tubing, a torque plate, and a top holding plate. The seal element is positioned between the bottom holding plate and the torque plate, and the torque plate is configured to move in a longitudinal direction toward the bottom holding plate to compress the seal element between the bottom holding plate and the torque plate. The top holding plate can mount to the retention plate, and the top holding plate includes an adjustment mechanism engaged with the torque plate. The adjustment mechanism controls movement of the torque plate in the longitudinal direction.

This, and other aspects, can include one or more of the following features. The top holding plate can include a threaded aperture, and the adjustment mechanism can include a lockdown screw engaged with the threaded aperture. The torque plate can include a wedge surface engaged with the lockdown screw, where the torque plate moves in response to a movement of the lockdown screw. The lockdown screw can be disposed through the top holding plate in a lateral direction that is perpendicular to the longitudinal direction, an end of the lockdown screw can contact the wedge surface of the torque plate, and the movement of the lockdown screw in the lateral direction can control the movement of the torque plate in the longitudinal direction. The top holding plate can include a first aperture, the retention plate can include a second aperture aligned with the first aperture, and the annulus seam system can further include a retention fastener positioned through the first aperture and the second aperture to mount the top holding plate to the retention plate. The retention fastener can include a stud positioned through the first aperture and the second aperture, and retention nuts to secure the stud to the top holding plate and retention plate. The retention fastener can include a bolt positioned through the first aperture and the second aperture, and a retention nut coupled to the bolt. A bottom surface of the top holding plate can mount to the first surface of the retention plate. The annulus seal system can further include a second fastener for securing the top holding plate to the bottom holding plate. The top holding plate can include a second aperture, the bottom holding plate can include a threaded cap, and the second fastener can include a cap screw extending through the second aperture to the threaded cap. The retention plate can be welded to the first tubing. The retention plate can be a flanged end of the first tubing.

Certain aspects encompass a method for sealing a wellbore annulus. The method includes mounting, with a first fastener, a top holding plate of an annular isolation system to a first tubing disposed in a wellbore. The annular isolation system includes a bottom holding plate having an annular shape and comprising a first surface, a seal element having an annular shape and disposed on the first surface of the bottom holding plate, a torque plate disposed on the seal element and positioned opposite to the bottom holding plate, where the torque plate includes an annular shape, and the seal element is positioned between the bottom holding plate and the torque plate, and a top holding plate connected to the bottom holding plate and including an adjustment mechanism engaged with the torque plate. The method also includes moving the torque plate with the adjustment mechanism in a downhole direction, and in response to moving the torque plate in the downhole direction, compressing the seal element between the torque plate and the bottom holding plate, and sealing, with the seal element, an annulus between the first tubing and a casing disposed in the wellbore.

This, and other aspects, can include one or more of the following features. The top holding plate can include a threaded aperture, the adjustment mechanism can include a lockdown screw engaged with the threaded aperture, the torque plate can include a wedge surface engaged with the lockdown screw, and moving the torque plate with the adjustment mechanism can include rotating the lockdown screw within the threaded aperture and pushing the torque plate in the downhole direction with the lockdown screw in response to rotating the lockdown screw. Compressing the seal element between the torque plate and the bottom holding plate can include laterally expanding the seal element to sealingly engage with the first tubing and the casing.

In some aspects, an annulus seal system includes an annular isolation system to connect to a tubing disposed in a wellbore. The annular isolation system includes a bottom holding plate having an annular shape and comprising a first surface, a seal element having an annular shape and disposed on the first surface of the bottom holding plate, the seal element to expand in a radial direction, and a torque plate disposed on the seal element and positioned opposite to the bottom holding plate. The torque plate includes an annular shape, wherein the seal element is positioned between the bottom holding plate and the torque plate, and the torque plate moves in a longitudinal direction to compress the seal element between the bottom holding plate and the torque plate. The annular isolation system also includes a top holding plate connected to the bottom holding plate and including an adjustment mechanism engaged with the torque plate, the adjustment mechanism to control movement of the torque plate in the longitudinal direction.

This, and other aspects, can include one or more of the following features. The adjustment mechanism can include a lockdown screw through the top holding plate, the lockdown screw to move the torque plate in response to rotation of the lockdown screw. The torque plate can include a wedge surface configured to match a profile of the lockdown screw, wherein the wedge surface moves in response to rotation of the lockdown screw against the wedge surface of the torque plate. The annulus seal system can further include a fastener for securing the top holding plate to the bottom holding plate. The annulus seal system can further include a retention plate coupled to the tubing at an uphole longitudinal end of the tubing, and a fastener for securing the top holding plate to the retention plate, where the seal element can be disposed in an annulus of the wellbore between the tubing and a casing disposed radially within the tubing.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
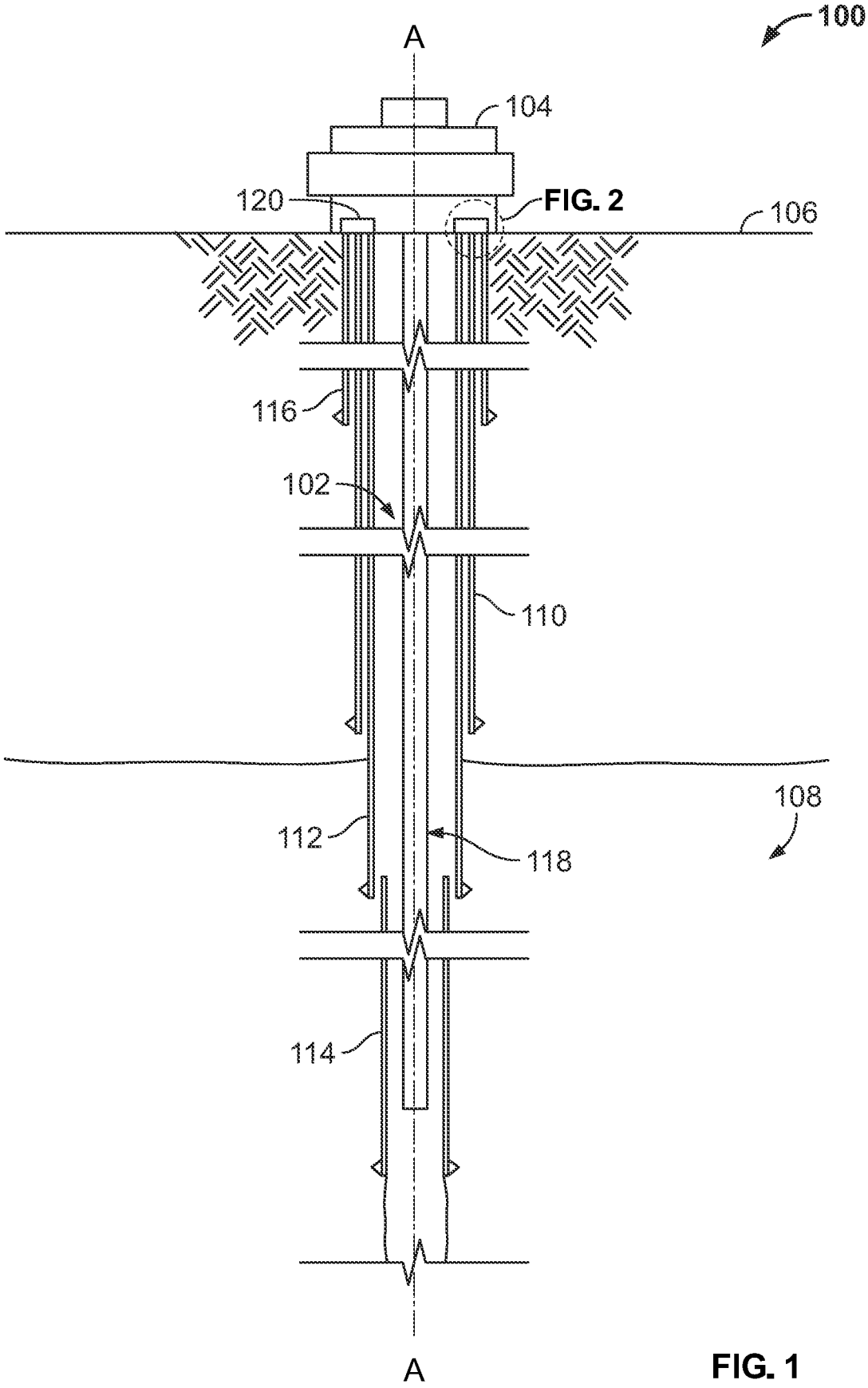
FIG. 1 is a schematic partial cross-sectional side view of an example well system including an annular isolation system.

This disclosure describes seal systems for annuli in a wellbore. An example annulus seal system can be positioned in an annulus between wellbore tubing, such as between a casing and a conductor, between conductors, between casings, or between other wellbore tubing, after the wellbore tubing is run into and positioned within a wellbore. The annulus seal system attaches to a longitudinally uphole end of a first tubing, and includes a flexible seal element that is disposed in an annulus between the first tubing and an adjacent tubing, such as adjacent and concentric casing tubing, to seal the annulus while also accounting for flexibility due to movement of the tubing and fluctuations in the size of the annulus during the life of the well. The example annulus seal system also includes an adjustment mechanism that acts to control a compression of the seal element, where the compression of the seal element results in a radial expansion of the seal element in the annulus.

In the oil and gas industry, wellheads are installed over open wellbores and on top of one or more surface casing that extend at least partially into the wellbore. Tubing installed in the wellbore prior to the installation of the surface casings are called conductors. A conductor is a pipe or tubing that is set into the ground and provides a foundation for a well to be drilled. A conductor is typically the first string of casing installed in a well, and can be lowered into a wellbore and cemented in place, driven into the ground (such as by a pile driver, or jetted into place such as in offshore wells), or otherwise positioned in a well. The example annulus seal system of the present disclosure can be mounted on a conductor to seal an annulus between the conductor and an adjacent casing, or can be mounted on any other tubing in a wellbore to seal the annulus at an uphole end of the annulus. The annulus or annuli between various conductors or between a conductor and a surface casing are often cemented or left open since no flowing formations are expected to flow through these annuli to the surface. Although production flow is not typically expected in these annuli, these annuli can leak to the environment through these open annuli. The annulus seal systems of the present disclosure can seal these annuli. In some conventional instances, a welded plate is used to isolate these annuli on existing wells, but these welds often crack or fail since a rigid weld does not factor in growth fluctuation of wellbore tubing, such as during start up and shut-in periods. The annulus seal system of the present disclosure includes a flexible seal that seals the annulus while also accounting for flexibility due to movement of the tubing and fluctuations in the size of the annulus during the life of the well.

In some instances, the annulus seal system includes a circular or split seal element, such as a packer element, that is positioned in place in an annulus by top and bottom holding plates. The top and bottom holding plates can be secured to each other with cap screws or other fasteners, and the seal element is energized (for example, radially expanded via compression) by one or more lockdown screws acting on a torque plate that acts to compress the seal element and seal off an open annulus. The top holding plate or the bottom holding plate is mounted on or otherwise coupled to a tubing, such as at an uphole longitudinal end of the tubing. A portion of the annulus seal system is positioned in the annulus, such that upon compression of the seal element, the seal element radially expands (for example, radially inward, radially outward, or both) to engage and seal against walls of the adjacent tubing.

FIG. 1 is a schematic partial cross-sectional side view of an example well system 100 that includes a substantially cylindrical wellbore 102 extending from a wellhead 104 at a surface 106 downward into the Earth into one or more subterranean zones of interest. In the example well system 100 of FIG. 1, one subterranean zone of interest 108 is shown. The well system 100 includes a vertical well, with the wellbore 102 extending substantially vertically from the surface 106 to the subterranean zone of interest 108. The concepts described here, however, are applicable to many different configurations of wells, including vertical, horizontal, slanted, or otherwise deviated wells.

After some or all of the wellbore 102 is drilled, a portion of the wellbore 102 extending from the wellhead 104 to the subterranean zone 108 can be lined with lengths of tubing, called casing. The wellbore 102 can be drilled in stages, and a casing may be installed between stages. In the example well system 100 of FIG. 1, the wellbore 102 is shown as having been drilled in multiple stages (for example, three stages), and the casings include a first surface casing 110, a second surface casing 112, and a third casing 114. The first surface casing 110 can be defined by lengths of tubing lining a first portion of the wellbore 102, the second surface casing 112 can be defined by lengths of tubing lining a second portion of the wellbore 102, and the third casing 114 can be defined by lengths of tubing lining a third portion of the wellbore 102. These portions of the wellbore can be overlapping. For example, the first surface casing 110 extends from the surface for a first length, and the second surface casing 112 extends from the surface for a second, longer length that overlaps the first length. The first casing 110 is shown as extending only partially down the wellbore 102; however, the first casing 110 can extend further into the wellbore 102, such as into the subterranean zone 108, or end further uphole in the wellbore 102 than what is shown schematically in FIG. 1. Likewise, the second casing 112 is shown as extending only partially along the wellbore 102 downhole of the first casing 110; however, the second casing 112 can extend further into the wellbore 102 or end further uphole in the wellbore 102 than what is shown schematically in FIG. 1. While FIG. 1 shows the example well system 100 as two surface casings (first casing 110 and second casing 112), the well system 100 can include more surface casings or fewer surface casings, or more or fewer casings that begin at a location downhole of the surface. For example, the well system 100 can include one, three, four, or more surface casings, and any number of downhole casings. In some examples, the well system 100 excludes casings, and the wellbore 102 is at least partially or entirely open bore.

The wellhead 104 is installed over the open wellbore 102 on top of the first surface casing 110 and second surface casing 112. The well system 100 also includes a pipe or tubing installed in the wellbore 102 prior to the installation of the surface casings 110 and 112, called a conductor 116. The example well system 100 includes one conductor 116 positioned radially outward of the first surface casing 110 and second surface casing 112 relative to central wellbore axis A-A. The conductor 116 is positioned adjacent to the first surface casing 110. The conductor 116 and the first surface casing 110 form an annulus between them, which can be cemented or left open, for example, since no flowing formations are expected to flow through this annuli to the surface 106.

The conductor 116 is set into the surface 106 of the Earth and provides a foundation for the wellbore 102 to be drilled. The conductor 116 is typically the first string of casing installed in the wellbore 102, and is lowered into the wellbore 102 and cemented in place, driven into the surface 106 (such as by a pile driver, or jetted into place such as in offshore wells), or otherwise positioned in the wellbore 102. The example well system 100 of FIG. 1 includes a single conductor 116, but the well system 100 can include additional conductors in or around the wellbore 102.

The wellhead 104 defines an attachment point for other equipment of the well system 100 to attach to the well 102. For example, the wellhead 104 can include a Christmas tree structure including valves used to regulate flow into or out of the wellbore 102. In the example well system 100 of FIG. 1, a tubing string 118 is shown as having been lowered from the wellhead 104 at the surface 106 into the wellbore 102. In some instances, the tubing string 118 includes a series of jointed lengths of tubing coupled end-to-end or a continuous (or, not jointed) coiled tubing. The tubing string 118 can include a drill string, production string, work string, testing string, or other well string with a well tubing used during the lifetime of the well system 100. The tubing string 118 can include a number of different well tools that can test, produce, intervene, or otherwise engage the wellbore 102.

The wellhead 104 of the example well system 100 also includes an annulus seal system 120 positioned at an uphole longitudinal end of the wellbore 102 above the conductor 116, first surface casing, second surface casing 112, or a combination of these. The annulus seal system 120 seals an annulus between two adjacent tubing, such as between the conductor 116 and the first surface casing 110, between the first surface casing 110 and the second surface casing 112, or both. The annulus defines the space between adjacent tubing in the wellbore 102, such as a conductor-casing-annulus between the conductor 116 and the first surface casing 110, or a casing-casing-annulus between the first surface casing 110 and the second surface casing 112. While the annulus seal system 120 of the example well system 100 of FIG. 1 is shown above the conductor 116, first surface casing 110, and second surface casing 112, the annulus seal system 120 can be installed in an annulus between any two adjacent tubing in the wellbore 102.

In some implementations, the example annulus seal system 120 is mounted on the conductor 116 to seal an annulus between the conductor 116 and the adjacent first surface casing 110, which resides radially inwardly of the conductor 116. However, the example annulus seal system 120 can be mounted on any other tubing in the wellbore 102 to seal the annulus at an uphole end of the annulus. The conductor-casing-annulus, casing-casing-annulus, or both, are cemented or left open, since no flowing formations are expected to flow through these annuli to the surface 106. However, although production flow is not typically expected in these annuli, these annuli can leak flow to the environment through these open annuli. The annulus seal system 120 acts to seal these annuli. The example annulus seal system 120 includes a flexible seal that radially expands to seal the annulus while also accounting for flexibility due to movement of the tubing and fluctuations in the size of the annulus during the life of the wellbore 102.

Figure 2:
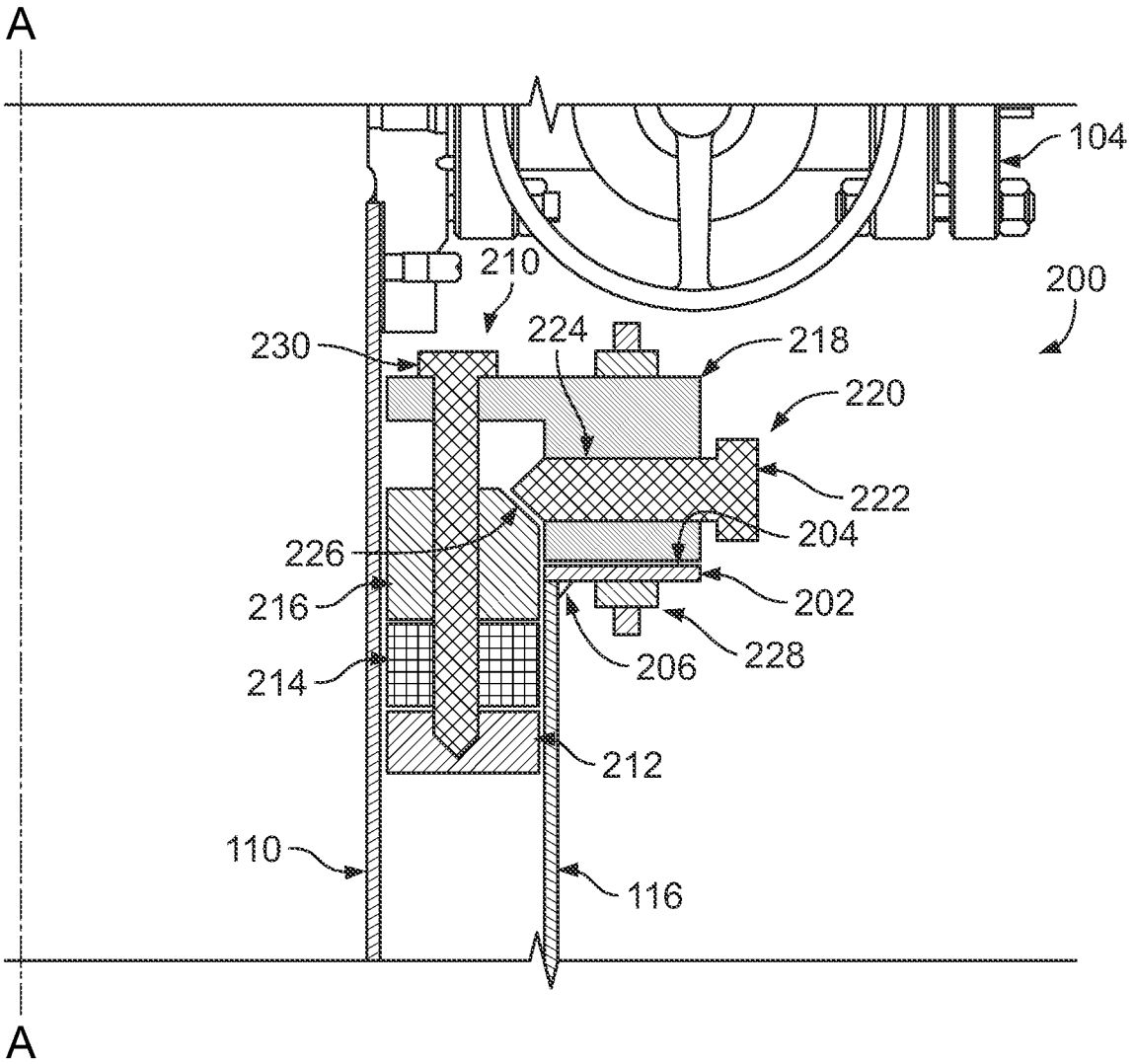
FIG. 2 is a partial cross-sectional side view of an example annulus seal system in an example tubing annulus.

FIG. 2 is a partial cross-sectional side view of an example annulus seal system 200 in an example tubing annulus. The example annulus seal 200 can be used in the example annulus seal system 120 in the example well system 100 of FIG. 1. For example, the example annulus seal system 200 of FIG. 2 is positioned between the conductor pipe 116 and the first surface casing 110 at the wellhead 104 of the example well system 100 of FIG. 1.

The example annulus seal system 200 includes a retention plate 202 mounted to the conductor 116 at an uphole longitudinal end of the conductor 116. In some instances, the retention plate 202 mounts to the first surface casing 110. The retention plate 202 includes a first surface 204 on an uphole side of the plate 202. The plate is oriented horizontally (substantially or exactly) relative to the vertical orientation of the conductor 116. In some implementations, the retention plate 202 is welded to the conductor 116, such as by a weld 206 on an underside of the retention plate 202 opposite of the first surface 204.

The annulus seal system 200 also includes an annular isolation system 210 that selectively couples to the retention plate 202, such as by mounting, fastening, or other type of connection. In some instances, the annular isolation system 210 couples to the conductor 116 or first surface casing 110 without the retention plate 202, and instead mounts (directly or indirectly) to a surface of the conductor 116, first surface casing 110, or other pipe structure. The annular isolation system 210 includes a bottom holding plate 212 positioned in the annulus between the conductor 116 and the first surface casing 110, a seal element 214 residing on the bottom holding plate 212, and a torque plate 216. The seal element is 214 is positioned between the bottom holding plate 212 and the torque plate 216, and is configured to seal the annulus between the conductor 116 and the first surface casing 110. The torque plate 216 can be biased to move in a longitudinal direction toward the bottom holding plate 212 to compress the seal element 214 between the bottom holding plate 212 and the torque plate 216.

The bottom holding plate 212, seal element 214, torque plate 216, or a combination of these, are sized to fit partially or entirely within the annulus between the adjacent tubing. These portions of the annular isolation system 220 can include a lateral dimension (for example, annular width) that is just less than a width of the annulus. Having an annular width that is just less than the width of the annulus itself allows the annular isolation system 220 to be lowered into the annulus, where the seal element 214 can subsequently be radially expanded (as described below) in order to seal the annulus.

The seal element 214 is radially expandable to engage and seal against the radially inner wall of the conductor 116 and the radially outer wall of the first surface casing 110. The seal element 214 can expand from a first, radially retracted position (as depicted in FIG. 2) to a second, radially expanded position that sealingly engages the conductor 116 and first surface casing 110 to seal the annulus from flow out of the longitudinally uphole end of the annulus. In the first position of the seal element 214, the annular isolation system 210 can be run into the annulus. In the second position of the seal element 214, the seal element 214 is radially expanded to engage and fluidly seal against the inner wall of the conductor 116 and the outer wall of the first surface casing 110, for example, to effectively plug (substantially or completely) the annulus from fluid flow across the seal element 214.

In some implementations, the seal element 214 includes an elastomeric ring-shaped (or partial ring-shaped) seal that, upon compression in the longitudinal direction, can extend radially (outward and inward). The elastomeric seal can be formed of an elastomeric material, such as rubber, silicone, polyurethane, or other elastomers. In some implementations, the seal element 214 can include an inflatable packer that inflates from the first position to the second position, a swellable packer that swells from the first position to the second position, a hydraulic actuated packer that actuates from the first position to the second position, or another type of expandable packer element.

The bottom holding plate 212, seal element 214, and torque plate 216 are partially or completely disposed within the annulus. The example annular isolation system 210 also includes a top holding plate 218 that connects to the bottom holding plate 212, seal element 214, torque plate 216, a combination of these, or all of these, to support the bottom holding plate 212, seal element 214, and torque plate 216 in the annulus. The top holding plate 218 connects to the retention plate 202, for example, by mounting directly onto the first surface 204 of the retention plate 202 or otherwise coupling to the retention plate 202. In some implementations, the top holding plate 218 can connect directly to the conductor 116, first surface casing 110, or another component to support the bottom holding plate 212, seal element 214, and in some instances the torque plate 216, within the annulus.

The top holding plate 218 includes an adjustment mechanism 220 engaged with the torque plate 216. The adjustment mechanism 220 controls the movement of the torque plate 216 in the longitudinal direction (parallel to axis A-A), for example, to control the compression of the seal element 214. In the example annular isolation system 210 of FIG. 2, the adjustment mechanism 220 includes a lockdown screw 222 that engages with a threaded aperture 224 through the top holding plate 218. In operation, as the lockdown screw 222 threads into threaded aperture 224 of the top holding plate 218, a distal end of the lockdown screw 222 presses against the torque plate 216 to move the torque plate 216 in a longitudinally downhole direction to compress the seal element 214, thereby radially expanding the seal element 214 to seal the annulus between the conductor 116 and the surface casing 110.

In some implementations, the torque plate 216 includes a wedge surface 226 that is engaged with the lockdown screw 222. For example, the wedge surface 226 is a chamfered edge of the torque plate 216 that engages with the angled end of the lockdown screw 222, which acts to transfer the lateral force from the lockdown screw 222 into longitudinal force on the torque plate 216. The torque plate 216 moves in response to movement of the lockdown screw 222. In some examples, the lockdown screw 222 is disposed through the top holding plate 218 in a lateral direction perpendicular to the longitudinal direction, and the distal end of the lockdown screw 222 is configured to contact the wedge surface 226 of the torque plate 216. The movement of the lockdown screw 222 in the lateral direction controls the movement of the torque plate 216 in the longitudinal direction.

The adjustment mechanism 220 of the example annular isolation system 210 is shown as the lockdown screw 222. However, the adjustment mechanism 220 can take other forms. For example, the adjustment mechanism 220 can include a spring-loaded pin that, once activated (or released), applies a force against the torque plate 216 to compress the seal element 214. In certain instances, the adjustment mechanism 220 can include fasteners on the top holding plate 218 that are energized, or torqued, to apply a downhole longitudinal force against the torque plate 216 to compress the seam element 214.

The adjustment mechanism 220 can include a single lockdown screw 222, or multiple lockdown screws 222 distributed along a partial or total length (for example, partial or total circumference) of the top holding plate 218. In some instances, the adjustment mechanism 220 includes four or more lockdown screws 222 spaced (evenly or unevenly) along the top holding plate 218, for example, to apply a more consistent force to the torque plate 216, and therefore an evenly distributed compressive force on the seal element 214.

A bottom surface of the top holding plate 218 mounts to the 204 first surface of the retention plate 202. In the example annulus seal system 200 of FIG. 2, the top holding plate 218 couples to the retention plate 202 with one or more retention fasteners 228. In some implementations, such as shown in the example annulus seal system 200 of FIG. 2, the one or more retention fasteners 228 include a retention stud and corresponding retention nuts that secure the top holding plate 218 to the retention plate 202. However, the one or more retention fasteners 228 can take other forms. In certain implementations, the top holding plate 218 is secured to the retention plate 202 with adhesive, welding, or different fasteners. In other implementations, the top holding plate 218 is mounted directly to the conductor 116, for example, without the retention plate 202. In some examples, the top holding plate 218 includes a first aperture and the retention plate 202 includes a second aperture aligned with the first aperture, where the retention fastener 228 is positioned through the first aperture and the second aperture to mount the top holding plate 218 to the retention plate 202.

In some implementations, the annular isolation system 210 includes one or more second fasteners 230 for securing the top holding plate 218 to the bottom holding plate 212. The second fastener 230 can include a cap screw that engages a threaded cap in the bottom holding plate 212. For example, the top holding plate 218 can include an aperture, the bottom holding plate 212 includes the threaded cap, and the cap screw extends through the aperture to the threaded cap. Other fastener types can be used to connect the top holding plate 218 to the bottom holding plate 212.

In some instances, the retention plate 202 is a flanged end of the conductor pipe 116. For example, instead of the retention plate 202 being welded to the conductor 116, the retention plate 202 can be integral with the conductor 116 as an outwardly flanged longitudinal end of the conductor 116.

The retention plate 202, top holding plate 218, bottom holding plate 212, torque plate 216, or a combination of these plates are formed of a rigid material that is durable enough to withstand the caustic environment of a wellbore. For example, each of these plates can be formed of a rigid metal.

The seal element 214 is compressed to seal off the annulus. The seal element can be energized to a desired degree using the adjustment mechanism 220. In some implementations, the seal element 214 can be replaced as desired or as needed, for example, by disconnecting and removing the annular isolation system 210 from the retention plate 202, replacing the seal element 214 with a new seal element, and reconnecting the annular isolation system 210 to the retention plate 202.

Figure 3:
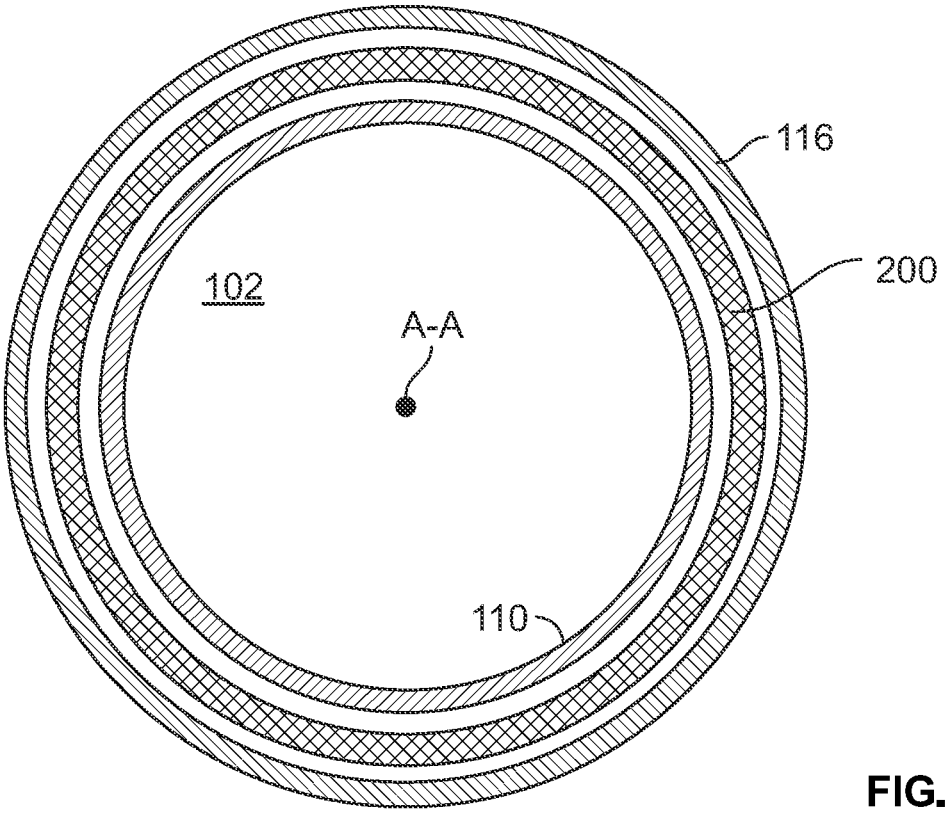
FIGS. 3 and 4 are partial cross-sectional top views of example annulus seal systems in an example tubing annulus.

FIG. 3 is a partial cross-sectional top view of the example annulus seal system 200 in the annulus between the conductor 116 and the first surface casing 110. The components of the example annulus seal system 200 have an annular shape (or partially annular shape) in order to reside in the annulus between the conductor 116 and the first surface casing 110.

Figure 4:
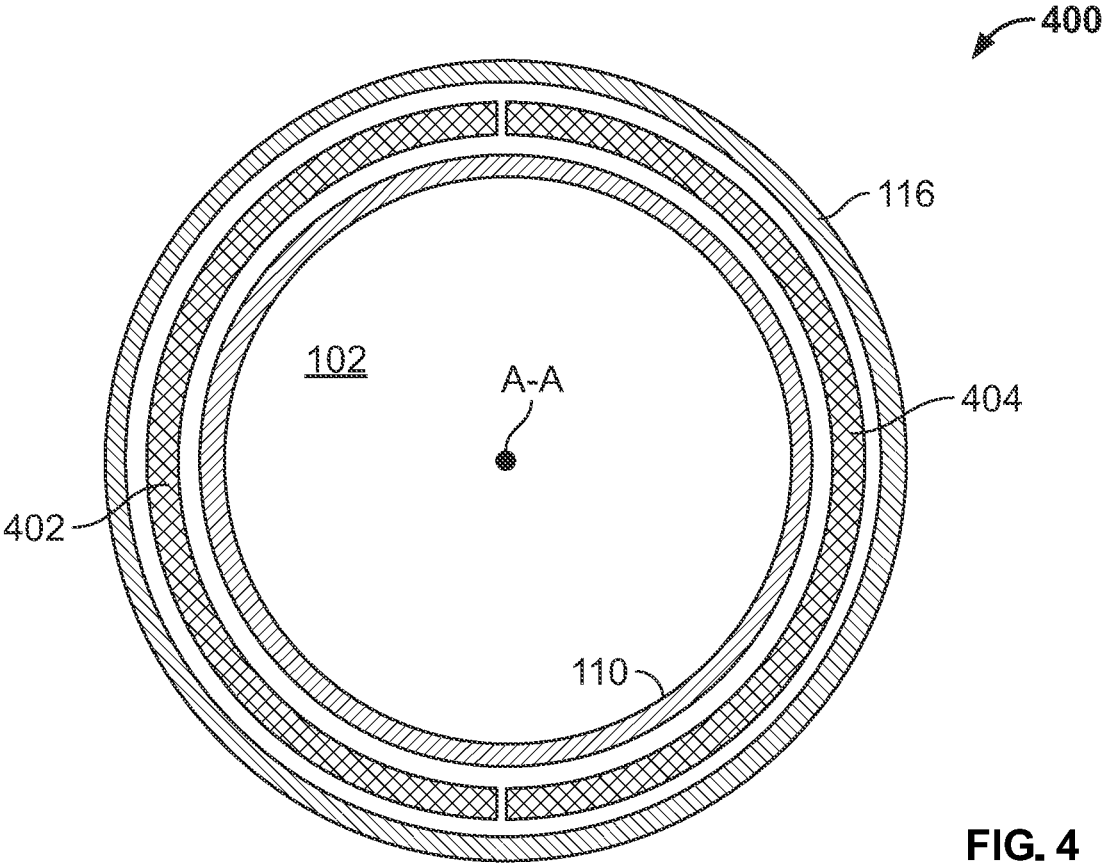

FIG. 4 is a partial cross-sectional top view of a second example annulus seal system 400 in the annulus between the conductor 116 and the first surface casing 110. The second example annulus seal system 400 is the same as the example annulus seal system 200 of FIGS. 2 and 3, except that the second example annulus seal system 400 is a split seal system having two semicircular seals 402 and 404. While the second example annulus seal system 400 is shown as split into two parts, in some examples, the seal system 400 can be split into more than two parts, such as three parts, four parts, or more than four parts.

Figure 5:
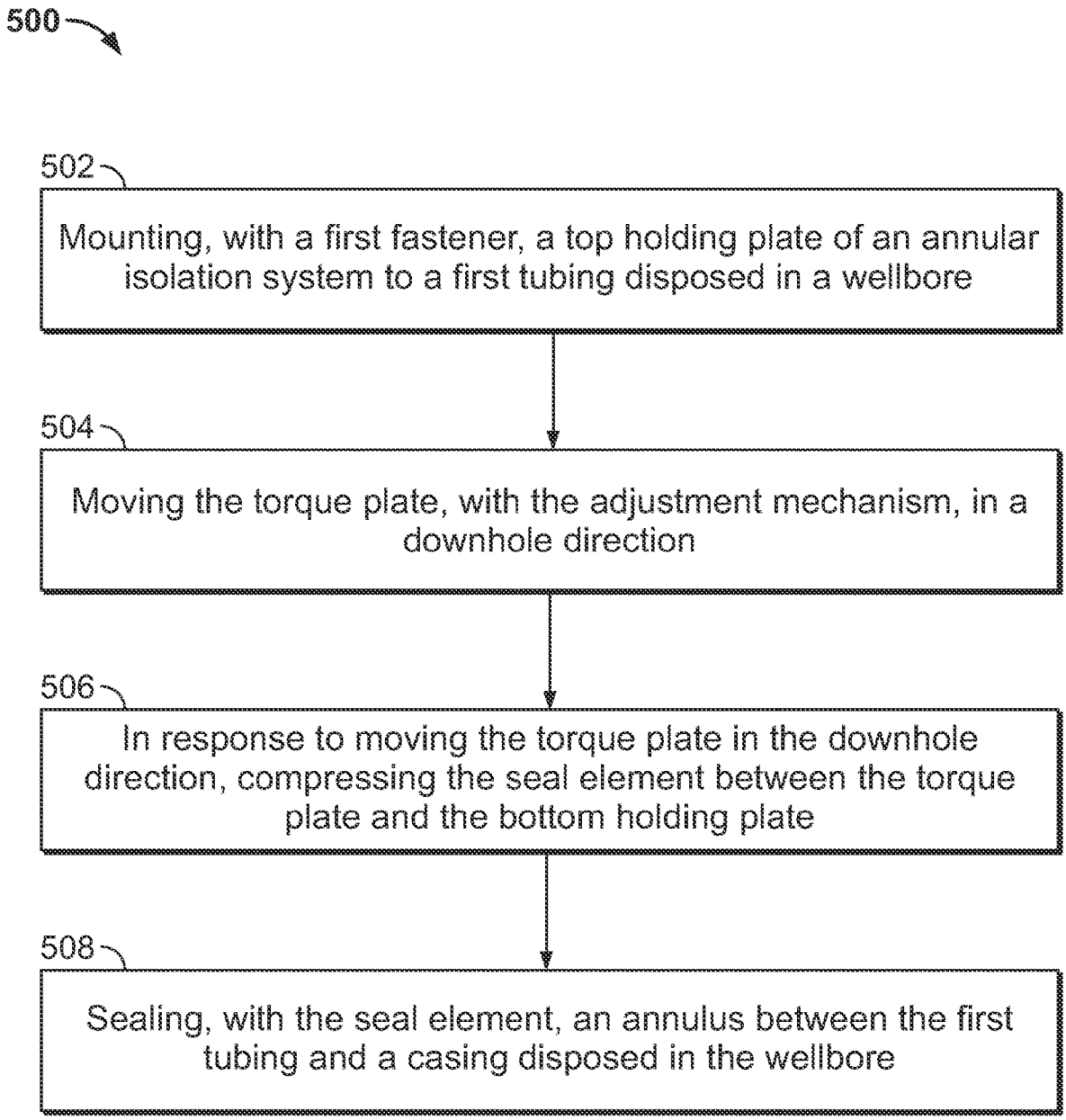
FIG. 5 is a flowchart describing an example method for sealing a wellbore annulus.

FIG. 5 is a flowchart describing an example method 500 for sealing a wellbore annulus, for example, performed by the example annulus seal systems 120, 200, or 400 of FIGS. 1-4. At 502, a first fastener mounts a top holding plate of an annular isolation system to a first tubing disposed in a wellbore. The annular isolation system includes a bottom holding plate having an annular shape and a first surface, a seal element having an annular shape and disposed on the first surface of the bottom holding plate, and a torque plate disposed on the seal element and positioned opposite to the bottom holding plate. The torque plate has an annular shape, and the seal element is positioned between the bottom holding plate and the torque plate. The annular isolation system also includes a top holding plate connected to the bottom holding plate and including an adjustment mechanism engaged with the torque plate. At 504, the adjustment mechanism moves the torque plate in a downhole direction. At 506, in response to moving the torque plate in the downhole direction, the seal element is compressed between the torque plate and the bottom holding plate. At 508, the seal element seals an annulus between the first tubing and a casing disposed in the wellbore. In some implementations, the top holding plate includes a threaded aperture, the adjustment mechanism includes a lockdown screw engaged with the threaded aperture, the torque plate includes a wedge surface engaged with the lockdown screw, and moving the torque plate with the adjustment mechanism includes rotating the lockdown screw within the threaded aperture to push the torque plate in the downhole direction with the lockdown screw in response to rotating the lockdown screw. In certain instances, compressing the seal element between the torque plate and the bottom holding plate includes laterally expanding the seal element to sealingly engage with the first tubing and the casing.

A number of implementations have been described. Nevertheless, it will be understood that various modifications may be made without departing from the spirit and scope of the disclosure.

What is claimed is:

1. An annulus seal system, comprising:

a retention plate configured to mount to a first tubing in a wellbore at an uphole longitudinal end of the first tubing, the retention plate comprising a first surface; and an annular isolation system configured to couple to the retention plate, the annular isolation system comprising:

a bottom holding plate configured to be positioned in an annulus between the first tubing and a second tubing positioned adjacent to the first tubing, a seal element residing on the bottom holding plate, the seal element configured to seal the annulus between the first tubing and the second tubing, a torque plate, wherein the seal element is positioned between the bottom holding plate and the torque plate, the torque plate configured to move in a longitudinal direction toward the bottom holding plate to compress the seal element between the bottom holding plate and the torque plate, a top holding plate configured to mount to the retention plate, the top holding plate comprising an adjustment mechanism engaged with the torque plate, the adjustment mechanism configured to control movement of the torque plate in the longitudinal direction; and a second fastener for securing the top holding plate to the bottom holding plate.

2. The annulus seal system of claim 1, wherein:

the top holding plate comprises a threaded aperture, and the adjustment mechanism comprises a lockdown screw engaged with the threaded aperture.

3. The annulus seal system of claim 2, wherein the torque plate comprises a wedge surface engaged with the lockdown screw, the torque plate configured to move in response to a movement of the lockdown screw.

4. The annulus seal system of claim 3, wherein the lockdown screw is disposed through the top holding plate in a lateral direction perpendicular to the longitudinal direction, an end of the lockdown screw is configured to contact the wedge surface of the torque plate, and the movement of the lockdown screw in the lateral direction controls the movement of the torque plate in the longitudinal direction.

5. The annulus seal system of claim 1, wherein the top holding plate comprises a first aperture, the retention plate comprises a second aperture aligned with the first aperture, and further comprising a retention fastener positioned through the first aperture and the second aperture to mount the top holding plate to the retention plate.

6. The annulus seal system of claim 5, wherein the retention fastener comprises a stud positioned through the first aperture and the second aperture, and retention nuts to secure the stud to the top holding plate and retention plate.

7. The annulus seal system of claim 5, wherein the retention fastener comprises a bolt positioned through the first aperture and the second aperture, and a retention nut coupled to the bolt.

8. The annulus seal system of claim 1, wherein a bottom surface of the top holding plate mounts to the first surface of the retention plate.

9. The annulus seal system of claim 1, wherein the top holding plate comprises a second aperture, the bottom holding plate comprises a threaded cap, and the second fastener comprises a cap screw extending through the second aperture to the threaded cap.

10. The annulus seal system of claim 1, wherein the retention plate is welded to the first tubing.

11. The annulus seal system of claim 1, wherein the retention plate is a flanged end of the first tubing.

12. A method for sealing a wellbore annulus, the method comprising:

mounting, with a first fastener, a top holding plate of an annular isolation system to a first tubing disposed in a wellbore, the annular isolation system comprising:

a bottom holding plate having an annular shape and comprising a first surface, a seal element having an annular shape and disposed on the first surface of the bottom holding plate, a torque plate disposed on the seal element and positioned opposite to the bottom holding plate, the torque plate comprising an annular shape, wherein the seal element is positioned between the bottom holding plate and the torque plate, and a top holding plate connected to the bottom holding plate and comprising an adjustment mechanism engaged with the torque plate;

moving the torque plate, with the adjustment mechanism, in a downhole direction;

in response to moving the torque plate in the downhole direction, compressing the seal element between the torque plate and the bottom holding plate;

sealing, with the seal element, an annulus between the first tubing and a casing disposed in the wellbore; and securing, with a second fastener, the top holding plate to the bottom holding plate.

13. The method of claim 12, wherein:

the top holding plate comprises a threaded aperture, the adjustment mechanism comprises a lockdown screw engaged with the threaded aperture, the torque plate comprises a wedge surface engaged with the lockdown screw, and moving the torque plate with the adjustment mechanism comprises rotating the lockdown screw within the threaded aperture and pushing the torque plate in the downhole direction with the lockdown screw in response to rotating the lockdown screw.

14. The method of claim 12, wherein compressing the seal element between the torque plate and the bottom holding plate comprises laterally expanding the seal element to sealingly engage with the first tubing and the casing.

15. An annulus seal system, comprising:

an annular isolation system configured to connect to a tubing disposed in a wellbore, the annular isolation system comprising:

a bottom holding plate having an annular shape and comprising a first surface, a seal element having an annular shape and disposed on the first surface of the bottom holding plate, the seal element configured to expand in a radial direction, a torque plate disposed on the seal element and positioned opposite to the bottom holding plate, the torque plate comprising an annular shape, wherein the seal element is positioned between the bottom holding plate and the torque plate, the torque plate configured to move in a longitudinal direction to compress the seal element between the bottom holding plate and the torque plate, a top holding plate connected to the bottom holding plate and comprising an adjustment mechanism engaged with the torque plate, the adjustment mechanism configured to control movement of the torque plate in the longitudinal direction; and a fastener for securing the top holding plate to the bottom holding plate.

16. The annulus seal system of claim 15, wherein the adjustment mechanism comprises a lockdown screw through the top holding plate, the lockdown screw configured to move the torque plate in response to rotation of the lockdown screw.

17. The annulus seal system of claim 16, wherein the torque plate comprises a wedge surface configured to match a profile of the lockdown screw, wherein the wedge surface moves in response to rotation of the lockdown screw against the wedge surface of the torque plate.

18. The annulus seal system of claim 15, further comprising:

a retention plate coupled to the tubing at an uphole longitudinal end of the tubing; and a fastener for securing the top holding plate to the retention plate;

wherein the seal element is configured to be disposed in an annulus of the wellbore between the tubing and a casing disposed radially within the tubing.

* * * * *